United States Patent [19]

Johansen

[11] Patent Number: 4,938,358

[45] Date of Patent: Jul. 3, 1990

[54] STORAGE CONTAINER

[75] Inventor: Hans A. Johansen, North Vernon, Ind.

[73] Assignee: Pantasote, Inc., Greenwich, Conn.

[21] Appl. No.: 395,884

[22] Filed: Aug. 18, 1989

[51] Int. Cl.[5] ..... B65D 85/62

[52] U.S. Cl. ..... 206/499; 206/303; 206/320; 206/511; 206/526

[58] Field of Search ..... 206/69, 303, 320, 321, 206/325, 499, 511, 525, 526; 220/75, 83, 84

[56] References Cited

U.S. PATENT DOCUMENTS

| | | | |
|---|---|---|---|
| 1,914,710 | 6/1933 | Bronander | 206/526 |
| 2,254,431 | 9/1941 | Levine | 206/69 |
| 2,545,089 | 3/1951 | Ladewig | 206/69 |
| 3,616,943 | 11/1971 | Brink | 206/511 |
| 3,665,943 | 5/1972 | Lampman et al. | 220/83 |
| 4,287,997 | 9/1981 | Rolfe et al. | 206/511 |
| 4,673,087 | 6/1987 | Webb | 206/511 |

*Primary Examiner*—David T. Fidei
*Attorney, Agent, or Firm*—Jacobs & Jacobs

[57] ABSTRACT

For storing frame-like objects during shipment, which comprises a box having a normally vertical wall portion and a normally horizontal base together defining an inner space, the box having an opening into the inner space; upper and lower pairs of elongated brackets projecting from the vertical wall portion into the inner space for supporting a plurality of frame-like objects suspended therefrom, the pairs of brackets each having proximal ends at the vetical wall portion and distal free ends, the pair of lower brackets being lower with respect to the base than and spaced inwardly of the pair of upper brackets, the upper and lower pairs of brackets being accessible through the opening, whereby the frame-like objects can be loaded onto and unloaded from the upper and lower brackets via the opening; and a movable cover for closing the opening of the box.

25 Claims, 4 Drawing Sheets

STORAGE CONTAINER

BACKGROUND OF THE INVENTION

The present invention relates to containers for storing frame-like objects during shipment, and more particularly to containers suitably for storing frame-like refrigerator and freezer door gaskets.

A variety of frame-like objects are manufactured in one location and shipped to another. Refrigerator and freezer door gaskets are well known and comprise a frame formed of PVC or other suitable plastic or rubbery material. Since these gaskets are made of flexible material, they must be protected during shipment from the gasket manufacturer to the refrigerator manufacturer to prevent damage occurring as a result of the gaskets being stretched, twisted or otherwise mishandled. Picture frames made of metal, wood or plastic must also be protected during shipment to retail stores for sale to customers.

Modern refrigerators are usually provided with a refrigerator compartment and a separate freezer compartment, generally of smaller size than the refrigerator compartment. Necessarily, the gaskets for the refrigerator door and the freezer door are of different size, and both gaskets are subject to damage during shipment as described above.

The present invention provides a container for storing frame-like objects and protecting them during shipment. In particular, the container according to the present invention has means for storing two different sizes of frame-like objects in a manner such that the frame-like objects are easily loaded into and unloaded from the container. When the container of the present invention is used for storing refrigerator and freezer door gaskets, a plurality of the larger refrigerator door gaskets and a plurality of the smaller freezer door gaskets can both be stored in the container of the invention.

SUMMARY OF THE INVENTION

In more detail, the present invention provides a container for storing frame-like objects during shipment, which comprises a box having a normally vertical wall portion and a normally horizontal base together defining an inner space, the box having an opening into the inner space; upper and lower pairs of elongated brackets projecting from the vertical wall portion into the inner space for supporting a plurality of frame-like objects suspended therefrom, the pairs of brackets each having proximal ends at the vertical wall portion and distal free ends, the pair of lower brackets being lower with respect to the base than and spaced inwardly of the pair of upper brackets, the upper and lower pairs of brackets being accessible through the opening, whereby the frame-like objects can be loaded onto and unloaded from the upper and lower brackets via the opening; and a movable cover for closing the opening of the box.

In a preferred embodiment of the invention, the upper brackets are spaced from the base a sufficient distance such that frame-like objects suspended at one end thereof from the pair of upper brackets will have its other end resting on and supported by the base, and in which a tray is provided projecting from the vertical wall portion into the inner space and located below the pair of lower brackets such that frame-like objects suspended at one end thereof from the lower pair of brackets will rest on and be supported at their other end by the tray.

In a further preferred embodiment of the invention, the upper and lower brackets are removably secured to the vertical wall portion to allow them to be removed and secured to other locations on the vertical wall portion, whereby the same container can be used for a variety of sizes of frame-like objects. If desired, the vertical wall portion may be provided with a plurality of apertures at predetermined locations to facilitate fastening the bracket to the desired locations on the wall portion. Alternatively, the mounting brackets can be fastened to one or more mounting plates that are fastened to the vertical wall portion.

In a further preferred embodiment of the invention, the box and cover are of sufficient strength to allow stacking of a plurality of closed boxes, one above the other, with the vertical wall portions of the boxes being disposed vertically. More specifically, it is preferred that the box and cover be made of plastic.

BRIEF DESCRIPTION OF THE INVENTION

The present invention is illustrated in terms of its preferred embodiments in the accompanying drawings, in which.

DESCRIPTION OF THE PREFERRED EMBODIMENTS

Figure 1:
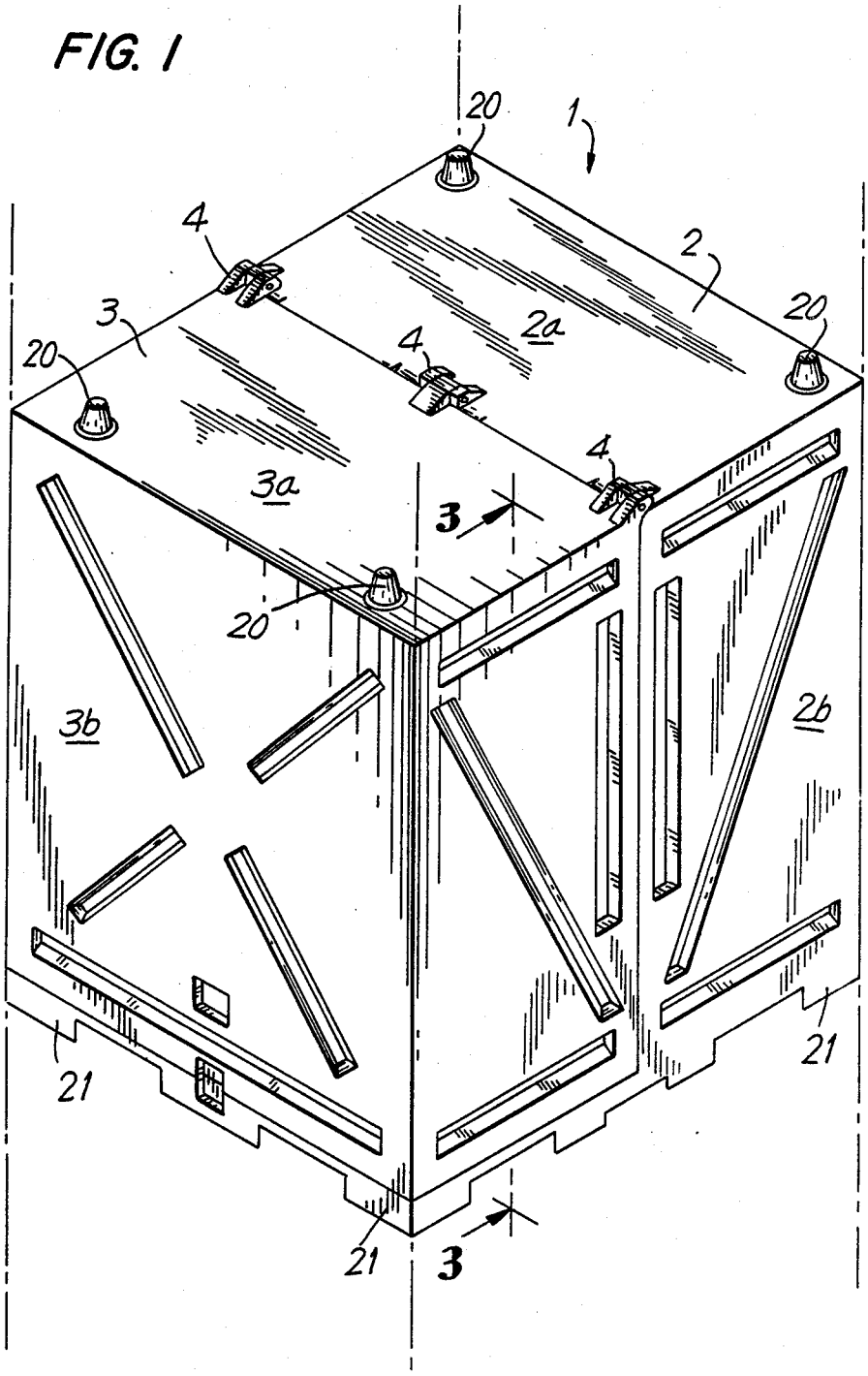
FIG. 1 is a view in perspective of a container according to the invention with the cover closed.
Figure 2:
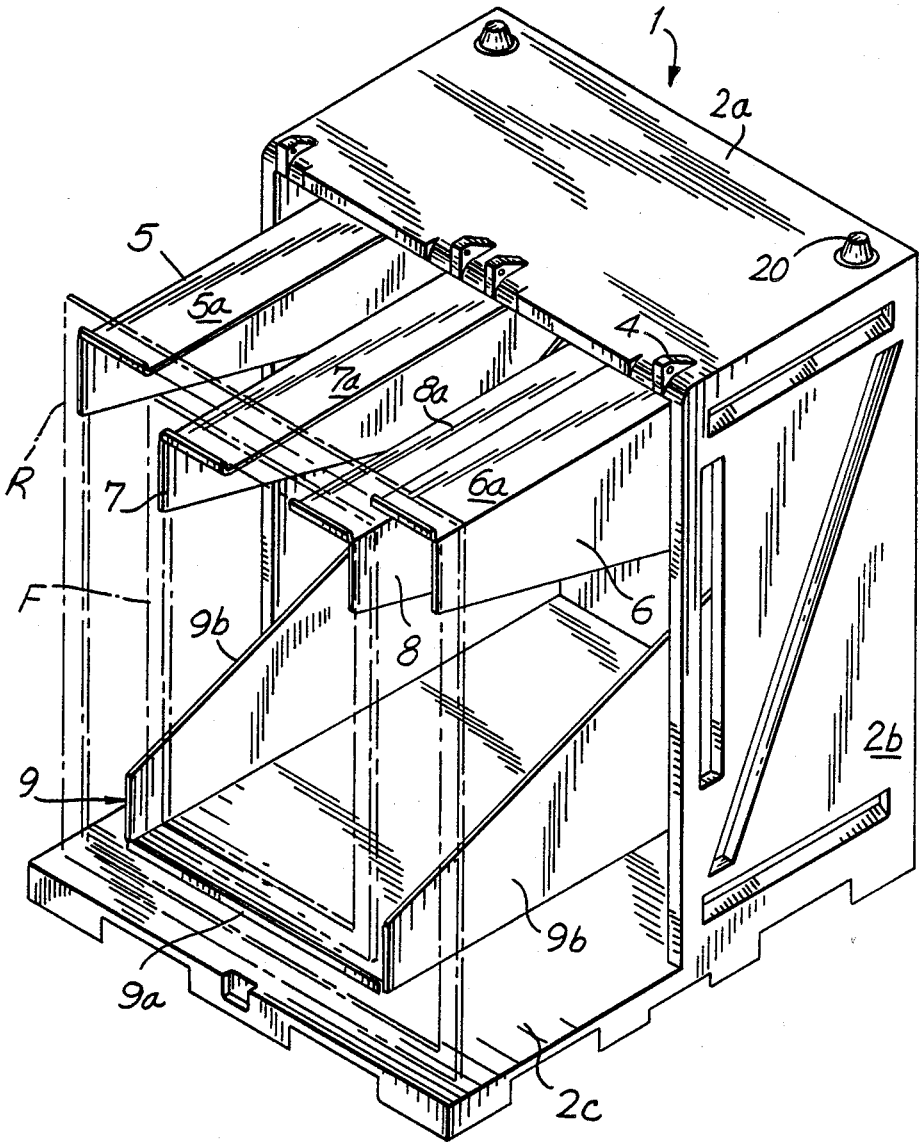
FIG. 2 is a view in perspective, similar to FIG. 1, but with the cover removed for clarity.
Figure 3:
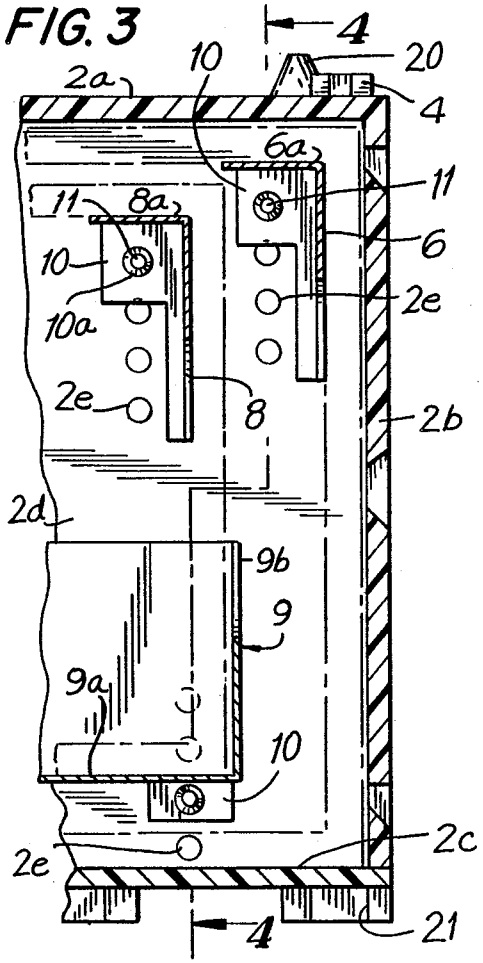
FIG. 3 is a front view, in section, taken along lines 3—3 of FIG. 1.

As illustrated in FIG. 1, the container 1 of the invention is comprised of a box 2 and a cover 3 swingably connected to the box 2 through hinges 4. Container 1 is shown in FIG. 1 in its normal position, in which box 2 has a normally horizontal top portion **2*a*, opposed, normally vertical side portions 2*b*, a normally horizontal base portion 2*c* (FIG. 2), and a normally vertical rear wall portion 2*d* (FIG. 3). Secured to the vertical rear wall portion 2*d* and projecting therefrom into the inner space defined by box 2 are a pair of upper brackets 5, 6 and a pair of lower brackets 7, 8, the lower brackets 7, 8 being lower with respect to the base portion 2*c* than the upper brackets 5, 6. The lower brackets 7, 8 are also spaced inwardly of the pair of upper brackets 5, 6 as best seen in FIGS. 2 and 3**.

Also projecting from the vertical rear wall portion **2*c* is a normally horizontal tray 7 located above base 2*c* and below and spaced inwardly of the upper brackets 5, 6**.

Figure 4:
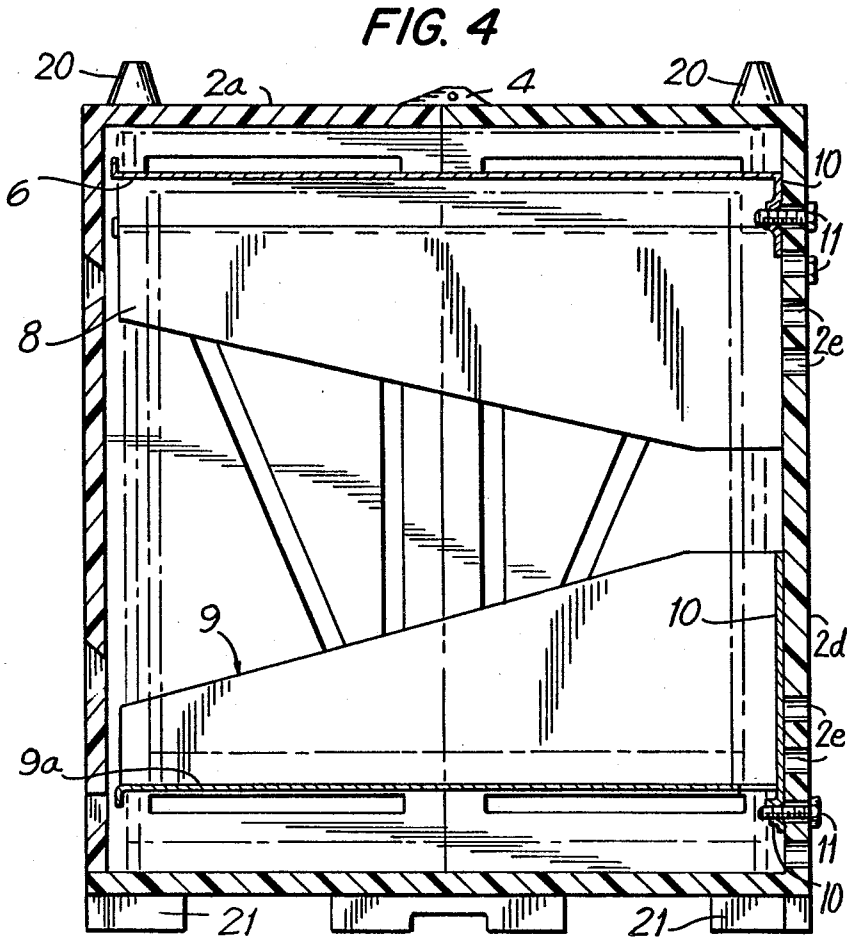
FIG. 4 is a side elevational view, in section, taken along lines 4—4 of FIG. 3.

As best seen in FIGS. 3 and 4, the vertical rear portion **2*d* is provided with a plurality of mounting holes 2*e*, while a mounting flange 10 is provided at the proximal end of each bracket 5, 6, 7, 8. The upper brackets 5, 6 and the lower brackets 7, 8 are fastened to the rear wall 2*d* by means of a suitable fastener 11 that projects through an aperture 2e in the rear wall 2d and an aligned aperture 10a in the mounting flange 10 of each bracket. As seen in FIGS. 2 and 4, the brackets 5, 6, 7 and 8 project from the vertical wall portion 2d into the inner space of box 2, with the proximal ends of the brackets being secured to the vertical wall portion 2d via the fastening means 11** and with the distal ends as free ends.

Fastening member 11 means takes the form of a nut and bolt, so as to enable rapid assembly and disassembly of the brackets 5, 6, 7, 8 and tray 9 from one location on wall portion 2d to another. However, any suitable fastening means 11 may be used, including, in some cases, a fastener that permanently affixes brackets 5, 6 and/or 7, 8 and/or tray 9 to wall portion 2d.

In operation, the container 1 is opened by swinging cover 3 about hinges 4, thereby opening box 2. Preferably, cover 3 is swung about hinges 4 so that its upper portion 3a (FIG. 1) rests upon the top portion 2a of the box 2. With the box 2 thus opened, the upper brackets 5, 6 and lower brackets 7, 8 are easily accessible through the opening in the box as best seen in FIG. 2. FIG. 2 also shows in phantom line a refrigerator door gasket R suspended at one end from the upper brackets 5, 6 with the other end of the gasket R resting on the base 2c. FIG. 2 also shows a freezer door gasket F suspended at one end from the lower brackets 7, 8 and having its other end rested on and supported by the surface 9a of the tray 9. To provide tray 9 with sufficient rigidity, it is preferred that tray 9 include opposed vertical wall portions 9b. Wall portions 9b also prevent the freezer door gaskets F from swinging and contacting the gaskets R. As in the case of the brackets 5, 6, 7 and 8, tray 9 has a mounting flange 10 (FIGS. 3 and 4), which has an aperture 10a that can be aligned with an aperture 2e such that the fastening means 11 can secure the tray 9 to the vertical wall portion 2d. If desired, mounting flanges 10 may have several apertures 10a.

The brackets 5, 6, 7 and 8 are sufficiently long such that a plurality of gaskets R and a plurality of gaskets F can be stored side-by-side suspended from bracket 5, 6 and 7, 8, respectively. Preferably, brackets 5, 6, 7, 8 have normally horizontal flanges 5a, 6a, 7a, 8a that provide horizontal surfaces on which the gaskets R, F may rest when suspended from the brackets. The upper brackets 5, 6 and lower brackets 7, 8 are accessible through the opening in the box 2 whereby the gaskets R, F can be loaded onto and unloaded from brackets 5, 6, 7 and 8 through the opening in the box. After the gaskets R, F have been loaded into the box 2, the cover 3 is swung from its open position as described above to the closed position wherein the cover 3 closes the opening of the box as shown in FIG. 1.

It is preferred that box 2, cover 3, upper brackets 5, 6, lower brackets 7, 8 and tray 9 be made of rotationally molded plastic due to economies of manufacture and desired strength characteristics, such as rotationally molded polyethylene. It is likewise preferred that the box 2 and cover 3 are of sufficient strength to allow stacking of a plurality of closed boxes (not shown) one above the other with the vertical wall portions 2d of the boxes 2 disposed vertically. To facilitate stacking of the boxes 2, the top 2a of box 2 and the top 3a of cover 3 are provided with lugs 20 that fit inside feet 21 (FIGS. 3 and 4) of box 2.

Referring again to FIG. 2, the container 1 of the present invention is particularly suited for storing and shipping flexible frame-like objects such as plastic refrigerator and freezer door gaskets. Where the frame-like objects are refrigerator or freezer door gaskets or similar material made of elastic or rubbery material, it is desirable to locate the upper brackets 5, 6 a distance from base 2c such that one end of the elastic, stretchable gasket R is supported by the brackets 5, 6 while the other end rests upon and is supported by the base 2c. Similarly, one end of gasket F desirably rests upon and is supported by brackets 7, 8 while the other end rests upon and is supported by the surface 9a of tray 9. In this manner, the lower ends of gaskets R, F are supported by the base 2c and tray 9 to avoid distortion of the gaskets caused by the gaskets stretching under their own weight.

The top 2a of box 2 is preferably at a height above base 2c to accommodate a gasket R of any size within a range of sizes. Suitably, box 2 is about 50 to about 52 inches high, about 44 to about 46 inches deep and about 38 to about 42 inches wide. With the height of the box 2 thus chosen, tray 9 is fastened at a predetermined location while brackets 5, 6, 7, 8 are adjustably located to support gaskets F within a variety of sizes. Of course, box 2 may have other dimensions. Brackets 5, 6, 7, 8, are dimensioned to hold the desired number of gaskets.

Vertical wall portion 2d may be pre-drilled or otherwise provided with a plurality of apertures 2e so that any given container 1 can be rapidly adjusted to accommodate a particular size of gaskets R and F merely by fastening the brackets 5, 6, 7 and 8 to wall portion 2d at the desired locations using pre-selected apertures 2e. If need be, the wall portion 2d can be drilled in the field to provide apertures 2e.

It is presently preferred that the box 2 have partial top portion 2a and opposed side walls 2b for ease of loading and unloading the gaskets, with the cover 3, when closed, completing the top and side walls of box 2 and providing a front wall 3b (FIG. 1) for the box 2. Other configurations of the cover 3 are possible so long as the upper brackets 5, 6, lower brackets 7, 8 and tray 9 are accessible when the cover 3 is in its open position.

It is likewise preferred that the mounting flange 10 are planar such that they provide a mounting surface in contact with the vertical wall portion 2d when the brackets 5, 6, 7, 8 and tray 9 are secured to the vertical wall portion 2d.

Where the frame-like objects stored within container 1 are rigid and not elastic, such as wooden picture frames, then tray 9 may not be required. However, tray 9 may be desirable even for stiff and rigid frame-like objects because the tray 9, and particularly the walls 9b, will serve to confine and thus stabilize the objects suspended from brackets 7, 8 during transport of the container 1.

Figure 6:
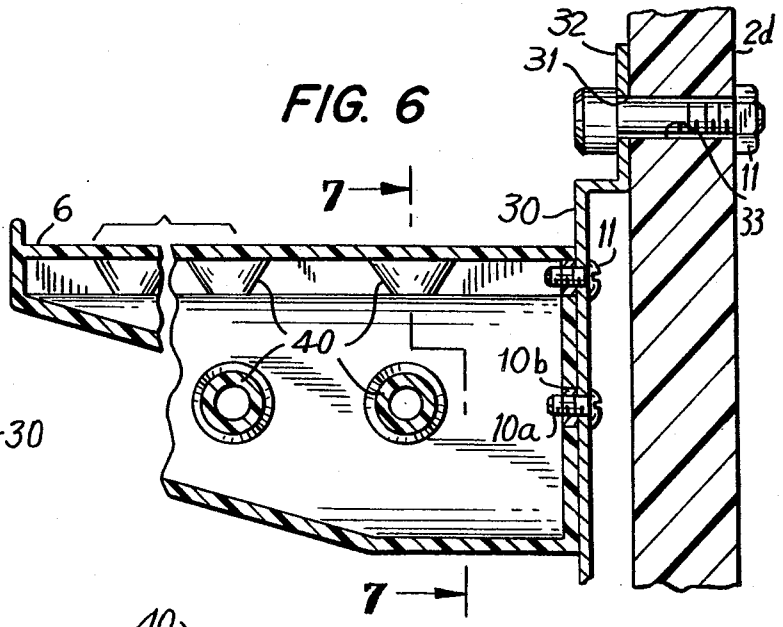
FIG. 6 is a detail view, in section, taken along lines 6—6 of FIG. 5, of a sub-assembly of the container of FIG. 5.
Figure 7:
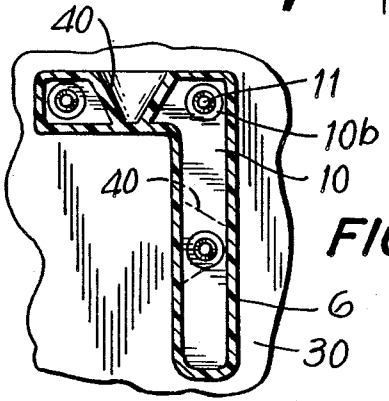
FIG. 7 is a detail view, in section, taken along lines 7—7 of FIG. 6.
Figure 5:
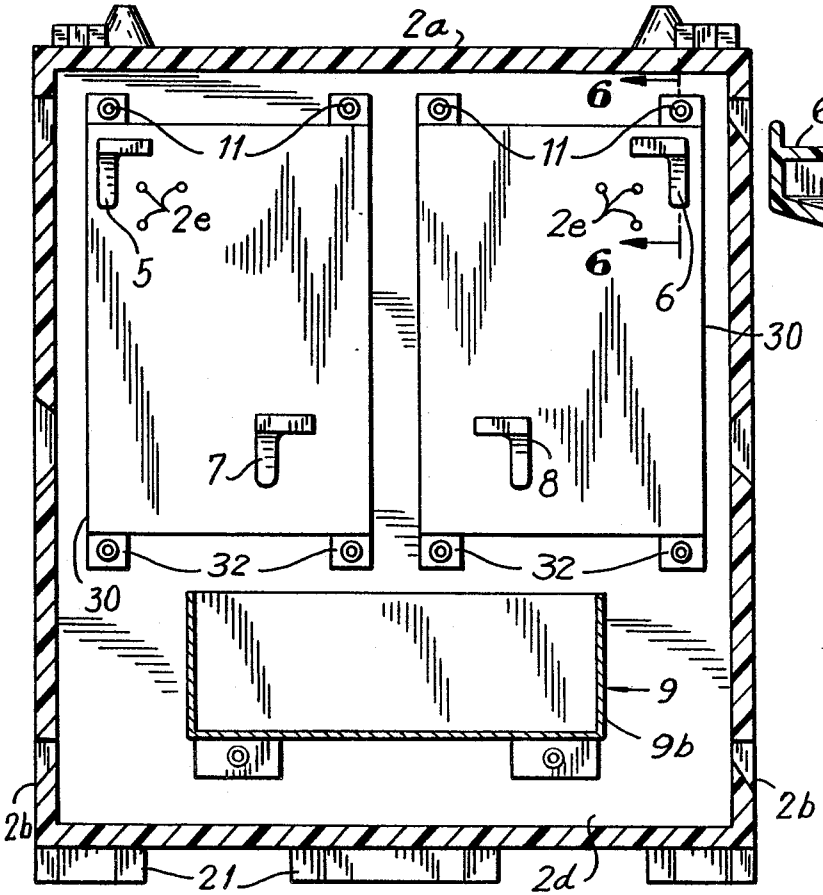
FIG. 5 is a front view, in section, similar to FIG. 3, of another embodiment of the invention.

FIGS. 5–7 illustrate a presently preferred embodiment of the invention in which mounting flanges 10 of brackets 5, 6, 7, 8 have three apertures 10a therein. Instead of being mounted directly on vertical wall portion 2d, the brackets 5, 6, 7, 8 shown in FIG. 5 are first fastened to the mounting surface of mounting plate 30 by means of screw fasteners 11 and threaded apertures 10a to form a sub-assembly (FIG. 6) that is then secured to wall 2d by means of fasteners 11 passing through apertures 31 in feet 32, which are located at each corner of mounting plate 30, and through apertures 33 in wall 2d.

It is presently preferred that brackets 5, 6, 7 and 8 be made of rotationally molded plastic. Threaded inserts 10b (FIG. 6), preferably of metal, are provided in the mold used to make the brackets, so that the inserts 10*b* become integral with the brackets after the molding operation is completed. Cone-shaped ribs 40 rigidify the legs of the brackets 5, 6, 7, 8.

As seen in FIG. 5 mounting plate 30 has four series of groups of three apertures 2*e*, each group corresponding to the pattern of apertures 10*a* in mounting flanges 10 of brackets 5, 6, 7, 8, and each series corresponding to one of the brackets 5, 6, 7, 8. Preferably, mounting plate 30 is made of metal, and two such plates are used as shown in FIG. 5. In this way, each mounting plate 30 can be securely fastened to wall 2*d* by using fasteners 11 that are widely spaced horizontally and vertically, thereby minimizing the possibility of failure of the plastic wall 2*d* due to the load carried by brackets 5, 6, 7, 8.

It is presently preferred to dedicate a plurality of sets of plates 30 for each customer to accommodate the different sizes of gaskets used by that customer. In the embodiment shown in FIGS. 5–7, the set of plates 30 for customer X has two series of two groups of apertures 2*e* corresponding to brackets 5 and 6 and two series of one group of apertures 2*e* corresponding to brackets 7, 8. Brackets 5, 6 will be located at the outermost group of apertures 2*e* as shown or the innermost group. In this way, all of the gaskets R and F shipped to customer X can be accommodated by the depicted plates 30 and brackets 5, 6, 7, 8. Other schemes are, of course, possible, such as "universal" plates 30 (not shown) having a plurality of apertures 2*e* in a rectilinear array of rows and columns.

As is evident from FIG. 6, feet 32 space mounting plate 30 from wall 2*d* to accommodate that portion of fastener 11 passing through mounting flanges 10 and plate 30. When the brackets 5, 6, 7, 8 are mounted on mounting plate 30 with fasteners that do not pass through plate 30, then plate 30 can be mounted flush with wall portion 2*d*.

I claim:

1. A container for storing frame-like objects during shipment, which comprises:

(a) a box comprising a normally vertical wall portion and a normally horizontal base together defining an inner space, said box having an opening into said inner space, (b) upper and lower pairs of elongated brackets projecting from said vertical wall portion into said inner space for supporting a plurality of frame-like objects suspended therefrom, said pairs of brackets each having proximal ends at said vertical wall portion and distal free ends, (c) said pair of lower brackets being lower with respect to said base than and spaced inwardly of said pair of upper brackets, said upper and lower pairs of brackets being accessible through said opening, whereby said frame-like objects can be loaded onto and unloaded from said upper and lower brackets via said opening, and (d) a movable cover for closing said opening.

2. Apparatus according to claim 1, wherein said cover is hingedly mounted on said box for swingable movement between a closed position wherein said cover closes said opening and an open position in which said opening is uncovered.

3. Apparatus according to claim 1, wherein said brackets are removably secured to said vertical wall portion.

4. Apparatus according to claim 3, wherein said proximal end of each of said brackets includes a mounting portion having a mounting surface arranged to contact said vertical wall portion when said brackets are secured thereto.

5. Apparatus according to claim 4, wherein removable fastening means cooperates with said vertical wall portion and each said bracket mounting portion to removably secure said brackets to said vertical wall portion.

6. Apparatus according to claim 5, wherein said bracket mounting portion is a mounting flange having at least one aperture therein, said vertical wall portion having a plurality of apertures at predetermined locations, and said removable fastening means passes through aligned apertures in said mounting flanges and in said vertical wall portion for removably securing said brackets to said vertical wall portion with said mounting flanges in contact with said vertical wall portion.

7. Apparatus according to claim 1, wherein said opening is opposite said vertical wall portion and said brackets project from said vertical wall portion toward said opening.

8. Apparatus according to claim 7, wherein said box has partial top and opposed side walls, said vertical wall portion and said base being back and bottom walls, respectively, and said cover, when closed, providing a front wall and completing said top and side walls for said box.

9. Apparatus according to claim 1, wherein said box and cover are of sufficient strength to allow stacking of a plurality of closed boxes, one above the other, with said vertical wall portions of said boxes disposed vertically.

10. Apparatus according to claim 1, wherein said box and cover are made of rotationally molded plastic.

11. Apparatus according to claim 1, wherein said container also comprises:

(e) a tray projecting from said vertical wall portion into said inner space, said tray being between said base and said pair of lower brackets and inwardly of said pair of upper brackets such that an elongated frame-like object suspended at its upper end thereof from said lower brackets will have its lower end resting on and supported by said tray.

12. A container for storing plastic frame-like gaskets during shipment, which comprises:

(a) a box comprising a normally vertical wall portion and a normally horizontal base together defining an inner space, said box having an opening into said inner space, (b) upper and lower pairs of elongated brackets removably secured to and projecting from said vertical wall portion into said inner space for supporting a plurality of first and second elongated frame-like gaskets, respectively, suspended therefrom, said pairs of brackets each having proximal ends at said vertical wall portion and distal free ends, said pair of upper brackets being located above said base such that a said first gasket suspended at its upper end thereof from said upper brackets will have its lower end resting on and supported by said base, (c) said pair of lower brackets being lower with respect to said base than and spaced inwardly of said pair of upper brackets, said upper and lower pairs of brackets being accessible through said opening, whereby said gaskets can be loaded onto and unloaded from said upper and lower brackets via said opening, (d) a movable cover for closing said opening, and (e) a tray secured to and projecting from said vertical wall portion into said inner space, said tray having a normally horizontal gasket-supporting surface with a proximal end thereof at said vertical wall portion and a distal free end, and opposed side walls rising from said gasket-supporting surface; said tray being between said base and said pair of lower brackets and inwardly of said pair of upper brackets such that a said second gasket suspended at its upper end thereof from said lower brackets will have its lower end resting on and supported by said gasket-supporting surface.

13. Apparatus according to claim 12, wherein said brackets have a mounting flange with at least one aperture therein, said vertical wall portion having a plurality of apertures at predetermined locations, and removable fastening means passes through aligned apertures in said mounting flanges and in said vertical wall portion for removably securing said brackets to said vertical wall portion with said mounting flanges in contact with said vertical wall portion.

14. Apparatus according to claim 12, wherein said cover is hingedly mounted on said box for swingable movement between a closed position wherein said cover closes said opening and an open position in which said opening is uncovered.

15. Apparatus according to claim 14, wherein said box has partial top and opposed side walls, said vertical wall portion and said base being back and bottom walls, respectively, and said cover, when closed, providing a front wall and completing said top and side walls for said box.

16. Apparatus according to claim 12, wherein said box and cover are of sufficient strength to allow stacking of a plurality of closed boxes filled with gaskets, one above the other, with said vertical wall portions of said boxes disposed vertically.

17. Apparatus according to claim 16, wherein said box and cover are made of rotationally molded plastic.

18. A container for storing plastic frame-like gaskets during shipment, which comprises:

(a) a box comprising a normally vertical wall portion and a normally horizontal base together defining an inner space, said box having an opening into said inner space, (b) mounting plate means secured to said vertical wall portion, said mounting plate having a plurality of apertures therein, upper and lower pairs of elongated brackets removably secured to and projecting from said mounting plate into said inner space for supporting a plurality of first and second elongated frame-like gaskets, respectively, suspended therefrom, said pairs of brackets each having proximal ends at said mounting plate means and distal free ends, said pair of upper brackets being located on said mounting plate means above said base such that a said first gasket suspended at its upper end thereof from said upper brackets will have its lower end resting on and supported by said base, (c) said pair of lower brackets being lower with respect to said base than and spaced inwardly of said pair of upper brackets, said upper and lower pairs of brackets being accessible through said opening, whereby said gaskets can be loaded onto and unloaded from said upper and lower brackets via said opening, (d) a movable cover for closing said opening, and (e) a tray secured to and projecting from said vertical wall portion into said inner space, said tray being between said base and said pair of lower brackets and inwardly of said pair of upper brackets such that said second gasket suspended at its upper end thereof from said lower brackets will have its lower end resting on and supported by said tray.

19. Apparatus according to claim 18, wherein said brackets have a mounting flange with a plurality of apertures therein arranged in a pattern, said mounting plate means having a series of groups of apertures, each series being associated with one of said brackets and each group of apertures in a said series corresponding to the pattern of said apertures in said mounting flange of its associated bracket.

20. Apparatus according to claim 18, wherein said mounting plate means is fastened to said wall portion by means of fasteners widely spaced apart horizontally and vertically.

21. Apparatus according to claim 18, wherein said tray has a normally horizontal gasket-supporting surface with a proximal end thereof at said vertical wall portion and a distal free end, and opposed side walls rising from said gasket-supporting surface.

22. Apparatus according to claim 18, wherein said cover is hingedly mounted on said box for swingable movement between a closed position wherein said cover closes said opening and an open position in which said opening is uncovered.

23. Apparatus according to claim 22, wherein said box has partial top and opposed side walls, said vertical wall portion and said base being back and bottom walls, respectively, and said cover, when closed, providing a front wall and completing said top and side walls for said box.

24. Apparatus according to claim 18, wherein said box and cover are of sufficient strength to allow stacking of a plurality of closed boxes filled with gaskets, one above the other, with said vertical wall portions of said boxes disposed vertically.

25. Apparatus according to claim 18, wherein said box and cover are made of rotationally molded plastic.

* * * * *